US010584532B2

(12) United States Patent
Moss et al.

(10) Patent No.: US 10,584,532 B2
(45) Date of Patent: Mar. 10, 2020

(54) LADDERS WITH INTEGRATED SUPPORT, LADDER COMPONENTS AND RELATED METHODS

(71) Applicant: Wing Enterprises, Incorporated, Springville, UT (US)

(72) Inventors: N. Ryan Moss, Mapleton, UT (US); Sean R. Peterson, Santaquin, UT (US); Brian B. Russell, Taylorsville, UT (US); Gary M. Jonas, Springville, UT (US)

(73) Assignee: WING ENTERPRISES, INCORPORATED, Springville, UT (US)

( * ) Notice: Subject to any disclaimer, the term of this patent is extended or adjusted under 35 U.S.C. 154(b) by 0 days.

(21) Appl. No.: 14/661,504

(22) Filed: Mar. 18, 2015

(65) Prior Publication Data

US 2015/0267468 A1 Sep. 24, 2015

Related U.S. Application Data

(60) Provisional application No. 61/954,925, filed on Mar. 18, 2014.

(51) Int. Cl.
*E06C 1/12* (2006.01)
*E06C 7/48* (2006.01)
(Continued)

(52) U.S. Cl.
CPC ..... *E06C 1/12* (2013.01); *E06C 7/02* (2013.01); *E06C 7/423* (2013.01); *E06C 7/48* (2013.01)

(58) Field of Classification Search
CPC ..... E06C 7/44; E06C 7/423; E06C 1/20
See application file for complete search history.

(56) References Cited

U.S. PATENT DOCUMENTS 35,601 A * 6/1862 Fobes ..... E06C 7/48
182/206
197,294 A * 11/1877 Seymour ..... E06C 1/12
182/212
(Continued)

FOREIGN PATENT DOCUMENTS

GB 1524 1/1910
GB 586854 4/1947
(Continued)

OTHER PUBLICATIONS

PCT International Search Report for PCT International Patent Application No. PCT/US2015/021167, dated Jun. 18, 2015.

*Primary Examiner* — Katherine W Mitchell
*Assistant Examiner* — Candace L Bradford
(74) *Attorney, Agent, or Firm* — Dorsey & Whitney LLP

(57) ABSTRACT

A ladder is provided having a first assembly and a second assembly slidably coupled with the first assembly. The first assembly includes a first pair of spaced apart rails and a first plurality of rungs extending between and coupled to the first pair of spaced apart rails. the second assembly includes a second pair of spaced apart rails and a second plurality of rungs extending between and coupled to the second pair of spaced apart rails. A support apparatus is coupled with the first assembly and includes one or more arms that are pivotally displaced from a refracted position to a deployed position responsive to displacement of the first assembly a specified distance relative to the second assembly.

19 Claims, 10 Drawing Sheets

(51) Int. Cl.
*E06C 7/02* (2006.01)
*E06C 7/42* (2006.01)

(56) References Cited

U.S. PATENT DOCUMENTS 369,084 A * 8/1887 Smith ..... E06C 1/12 182/213
559,626 A * 5/1896 Snell ..... E06C 1/12 182/209
1,909,565 A * 5/1933 Babitt ..... E06C 7/46 182/109
2,143,783 A * 1/1939 Liebman ..... E06C 7/48 182/110
2,339,593 A * 1/1944 Weston ..... E06C 1/20 182/177
2,602,580 A * 7/1952 Noel ..... E06C 7/44 182/203
2,885,133 A * 5/1959 Nelson ..... A01D 46/243 182/169
3,590,951 A * 7/1971 Berger ..... E06C 7/48 182/206
4,002,223 A * 1/1977 Bernkrant ..... B63B 27/14 182/156
4,194,592 A 3/1980 Evans
4,502,566 A 3/1985 Wing
4,643,274 A 2/1987 Tataseo
4,964,488 A * 10/1990 Stewart ..... E06C 1/20 182/107
5,113,973 A 5/1992 Southern
5,117,943 A * 6/1992 Schmitt ..... E06C 7/06 182/213
5,429,207 A 7/1995 Frank et al.
5,511,632 A * 4/1996 Ermis ..... E06O 1/22 182/107
5,931,259 A * 8/1999 Hoey ..... E06C 7/48 182/107
6,044,930 A * 4/2000 Hayman ..... E06O 1/34 182/107
8,251,180 B1 * 8/2012 Paige ..... E06C 7/48 182/107
8,365,865 B2 * 2/2013 Moss ..... E06O 1/12 182/172
2007/0289812 A1 * 12/2007 Feemster ..... E06C 7/46 182/107
2012/0048647 A1 * 3/2012 Green ..... E06O 1/16 182/111
2012/0228059 A1 9/2012 Lampe et al.
2014/0041965 A1 * 2/2014 Hess ..... E06O 7/188 182/107
2014/0047782 A1 * 2/2014 Fahler ..... B65H 75/403 52/164
2014/0202793 A1 7/2014 Jonas et al.
2015/0075905 A1 * 3/2015 Ballard ..... E06C 7/48 182/107
2018/0002982 A1 * 1/2018 Dressel ..... E06C 7/48

FOREIGN PATENT DOCUMENTS

GB 2372532 A 8/2002
JP 2004353266 A 12/2004

* cited by examiner

LADDERS WITH INTEGRATED SUPPORT, LADDER COMPONENTS AND RELATED METHODS

CROSS-REFERENCE TO RELATED APPLICATIONS

This application claims the benefit of U.S. Provisional Application No. 61/954,925 filed Mar. 18, 2014, the disclosure of which is incorporated by reference herein in its entirety.

TECHNICAL FIELD

The present invention relates generally to ladders and, more particularly, to ladders having an integrated stand-off or stabilizer as well as related components, features and methods.

BACKGROUND

Ladders are conventionally utilized to provide a user thereof with improved access to elevated locations that might otherwise be inaccessible. Ladders come in many shapes and sizes, such as straight ladders, straight extension ladders, stepladders, and combination step and extension ladders. So-called combination ladders may incorporate, in a single ladder, many of the benefits of multiple ladder designs.

Ladders known as straight ladders or extension ladders are ladders that are not conventionally self-supporting but, rather, positioned against an elevated surface, such as a wall or the edge of a roof, to support the ladder at a desired angle. A user then ascends the ladder to obtain access to an elevated area, such as access to an upper area of the wall or access to a ceiling or roof. A pair of feet or pads, each being coupled to the bottom of an associated rail of the ladder, are conventionally used to engage the ground or some other supporting surface.

Often, the ladder is used in an area where the intended support structure (i.e., the structure against which the ladder will rest against) is less stable than desired. For example, often a straight ladder or an extension ladder may be placed against a rain gutter of a home or other building. Gutters are not always constructed to withstand substantial loads, particularly in the lateral direction. In placing a ladder against the edge of a gutter, and then placing force against the gutter while a user is climbing (often a dynamic "bouncing" force during the climbing action), the gutter may give or yield to certain degree, making the ladder somewhat unstable. Worse, the gutter might collapse or buckle, not only causing damage to the structure, but creating a safety hazard with the ladder suddenly shifting.

Various attempts have been made to provide a stand-off device to engage an adjacent wall or roof structure and avoid placing substantial loading on a gutter or other similar structure. Stand-off devices typically include a structure that removably clamps to one or more rungs (or one or more rails) of the ladder. However, such a structure is susceptible to improper installation—particularly in light of the device typically being coupled to the ladder with each use, and being removed from the ladder each time it is stored or transported. Improper installation or adjustment of the device may again result in a significant safety hazard.

As such, there is a continuing desire in the industry to provide improved functionality of ladders and/or to improve the safety and stability of such ladders.

SUMMARY

The present invention relates to ladders and, more particularly, various configurations of ladders, as well as to methods relating to the use and manufacture of ladders.

In one embodiment, a ladder is provided having a base section comprising a first pair of spaced apart rails and a first plurality of rungs extending between and coupled to the first pair of spaced apart rails. The ladder further includes a fly section comprising a second pair of spaced apart rails and a second plurality of rungs extending between and coupled to the second pair of spaced apart rails, the fly section being slidably coupled to the base section. A stand-off apparatus is coupled with the fly section, the stand-off apparatus comprising a first arm coupled with a first rail of the second pair of rails and pivotally displaced between a first position, wherein the first arm is substantially positioned within a volume defined by the second pair of rails, and a second position wherein a substantial portion of the first arm extends out of the volume defined by the second pair of rails.

In accordance with one embodiment, the stand-off apparatus further includes a second arm coupled with a second rail of the second pair of rails and pivotally displaced between a first position, wherein the second arm is substantially positioned within the volume defined by the second pair of rails, and a second position wherein a substantial portion of the second arm extends out of the volume defined by the second pair of rails. In one embodiment, the first arm may pivot between its first position and its second position independent of the pivotal displacement of the second arm.

In accordance with one embodiment, the stand-off apparatus is configured to automatically deploy the first arm from the first position to the second position upon displacing the fly section a predetermined distance relative to the base section in a first direction. In a further embodiment, the stand-off arm is configured to retract the first arm from the second position to the first position upon displacing the fly section relative to the base section in a section direction opposite the first direction.

In accordance with one embodiment, the ladder includes an actuating mechanism associated with the first arm, the actuating mechanism including: an engagement arm pivotally coupled to the first rail of the second pair of rails on a first side thereof; a pull arm coupled with the engagement arm and located on a second side of the first rail of the second pair of rails; and a cable coupled between the pull arm and the first arm.

In accordance with one embodiment, a first spring has a first end coupled with the first rail of the second pair of rails and a second end coupled with the first arm. In one embodiment a second spring is coupled between the cable and the pull arm. In one embodiment, the ladder includes a pulley, wherein cable passes through the pulley.

In accordance with one embodiment, the first arm includes a first, arcuate section and a second, substantially straight section. An end cap may be coupled with an end of the second section of the first arm.

In accordance with one embodiment, a locking mechanism is configured to selectively prohibit movement of the first arm from the first position to the second position. In one embodiment, wherein the locking mechanism includes a locking arm associated with the fly section, the locking arm being selectively displaceable between a first position and a second position.

In accordance with another embodiment of the present invention, another ladder is provided. The ladder includes a first assembly slidably coupled with a second assembly. The first assembly includes a first pair of spaced apart rails and a first plurality of rungs extending between and coupled to the first pair of spaced apart rails. The second assembly includes a second pair of spaced apart rails and a second plurality of rungs extending between and coupled to the second pair of spaced apart rails. A support apparatus is coupled with the first assembly, the support apparatus comprising a first arm, wherein the first arm is pivotally displaced from a retracted position to a deployed position responsive to displacement of the first assembly a specified distance relative to the second assembly.

In accordance with one embodiment, the support apparatus further comprises a second arm pivotally displaced from a retracted position to a deployed position responsive to displacement of the first assembly the specified distance relative to the second assembly.

In one embodiment, the first assembly is configured as base section and the second assembly is configured as a fly section. In another embodiment, the first assembly is configured as fly section and the second assembly is configured as a base section.

In accordance with one embodiment, a locking mechanism is configured to selectively prohibit movement of the first arm from the refracted position to the deployed position. In one embodiment, the locking mechanism includes a locking arm positioned adjacent the first arm, the locking arm being selectively displaceable between a first position and a second position.

It is noted that the embodiments described herein are not to be considered mutually exclusive of one another and that any feature, aspect or component of one embodiment described herein may be combined with other features, aspects or components of other embodiments.

BRIEF DESCRIPTION OF THE DRAWINGS

The foregoing and other advantages of the invention will become apparent upon reading the following detailed description and upon reference to the drawings in which.

DETAILED DESCRIPTION

Figure 1:
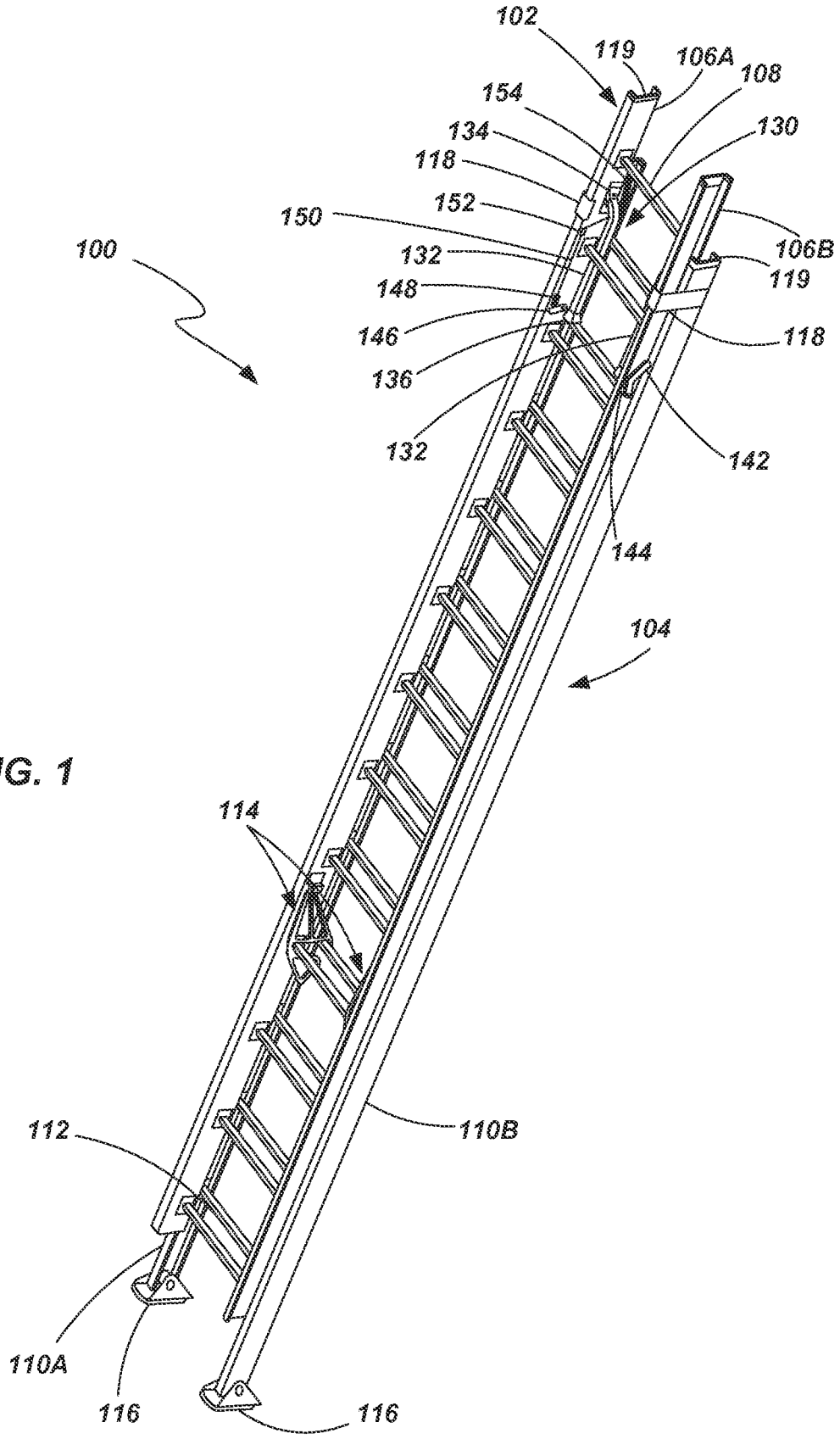
FIG. 1 is a perspective view of a ladder having a stand-off apparatus in a first position or state according to an embodiment of the present invention.
Figure 2:
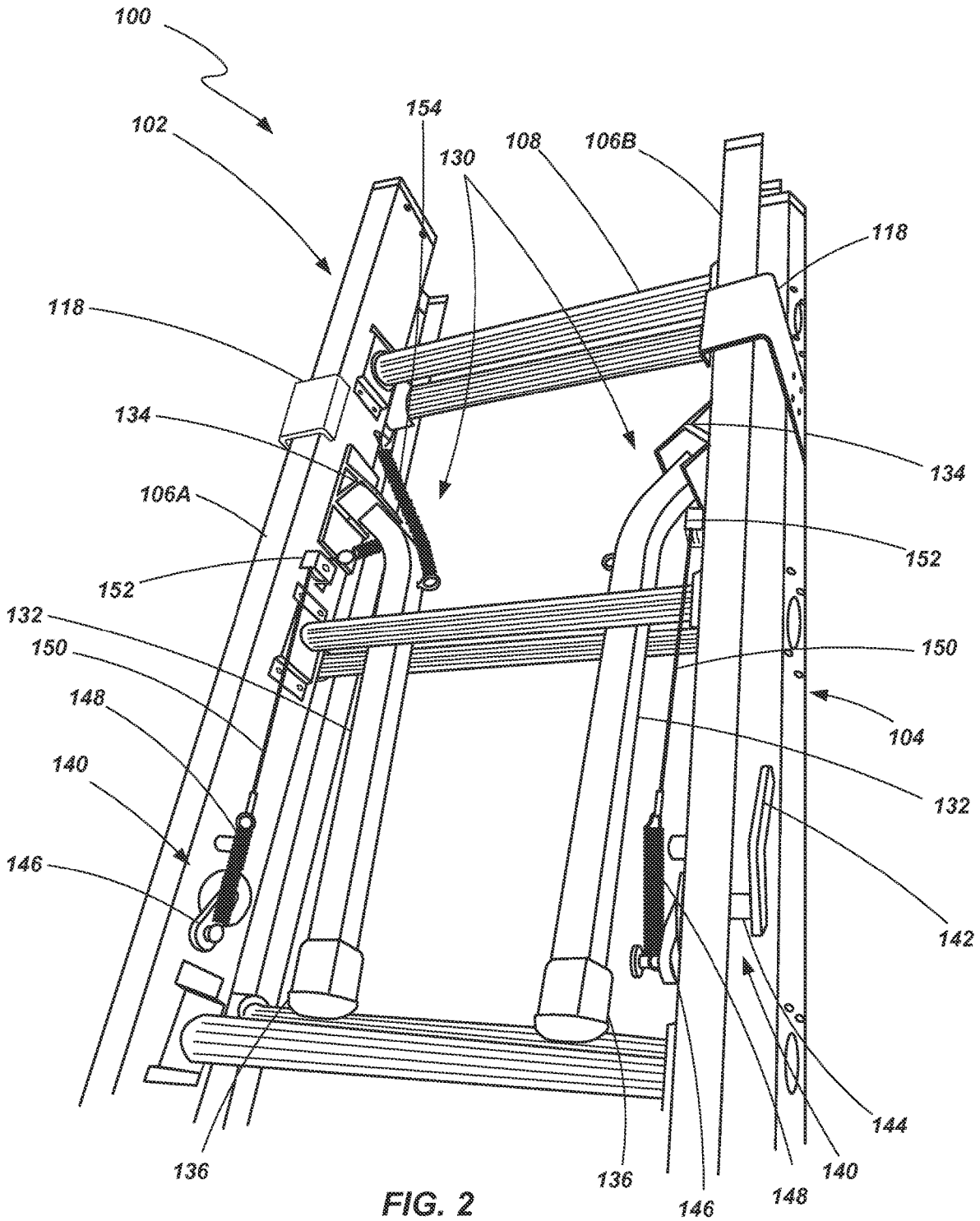
FIG. 2 is front perspective view of a portion of the ladder and apparatus shown in FIG. 1.
Figure 3:
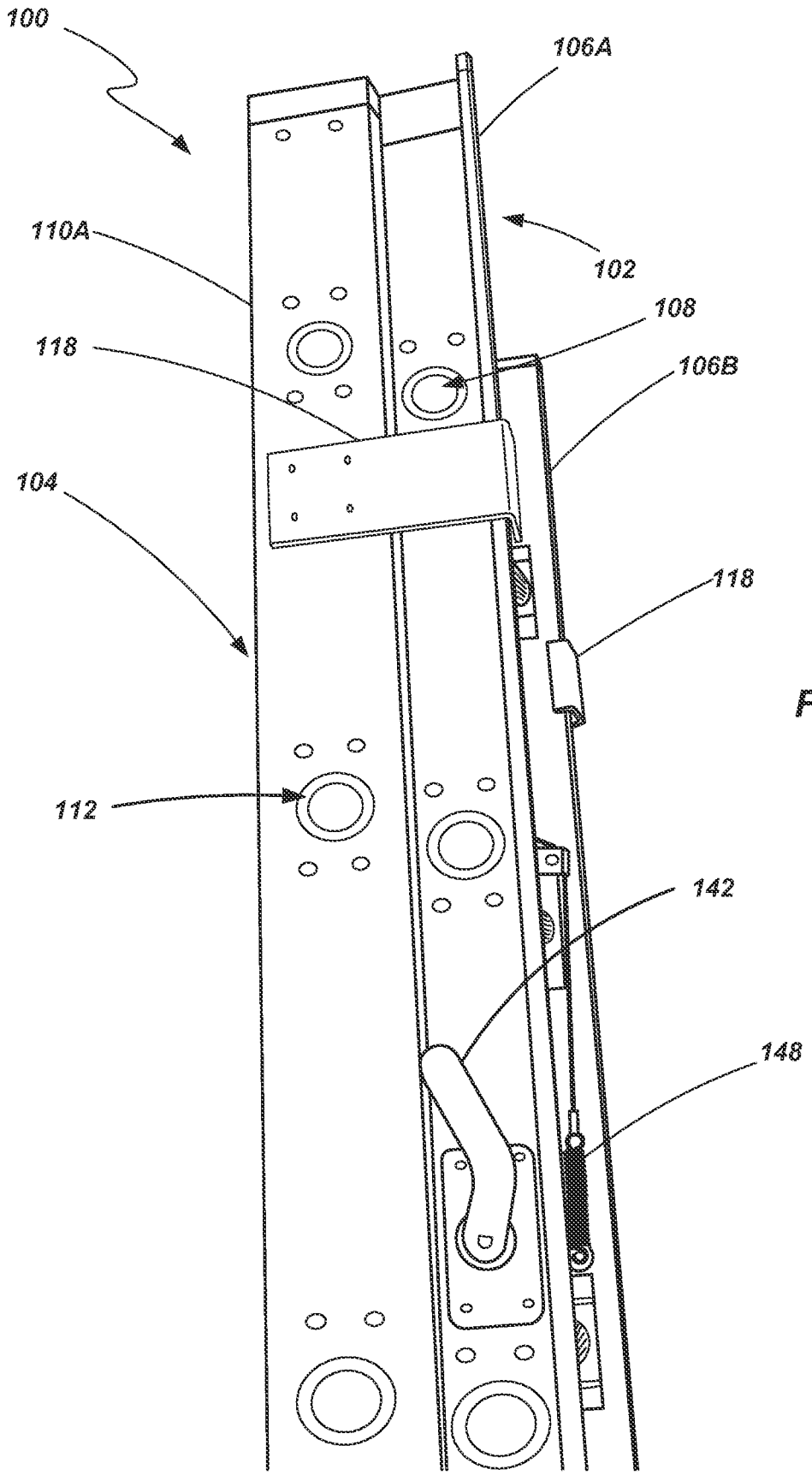
FIG. 3 is a side perspective view of a portion of the ladder and apparatus shown FIG. 1.
Figure 4:
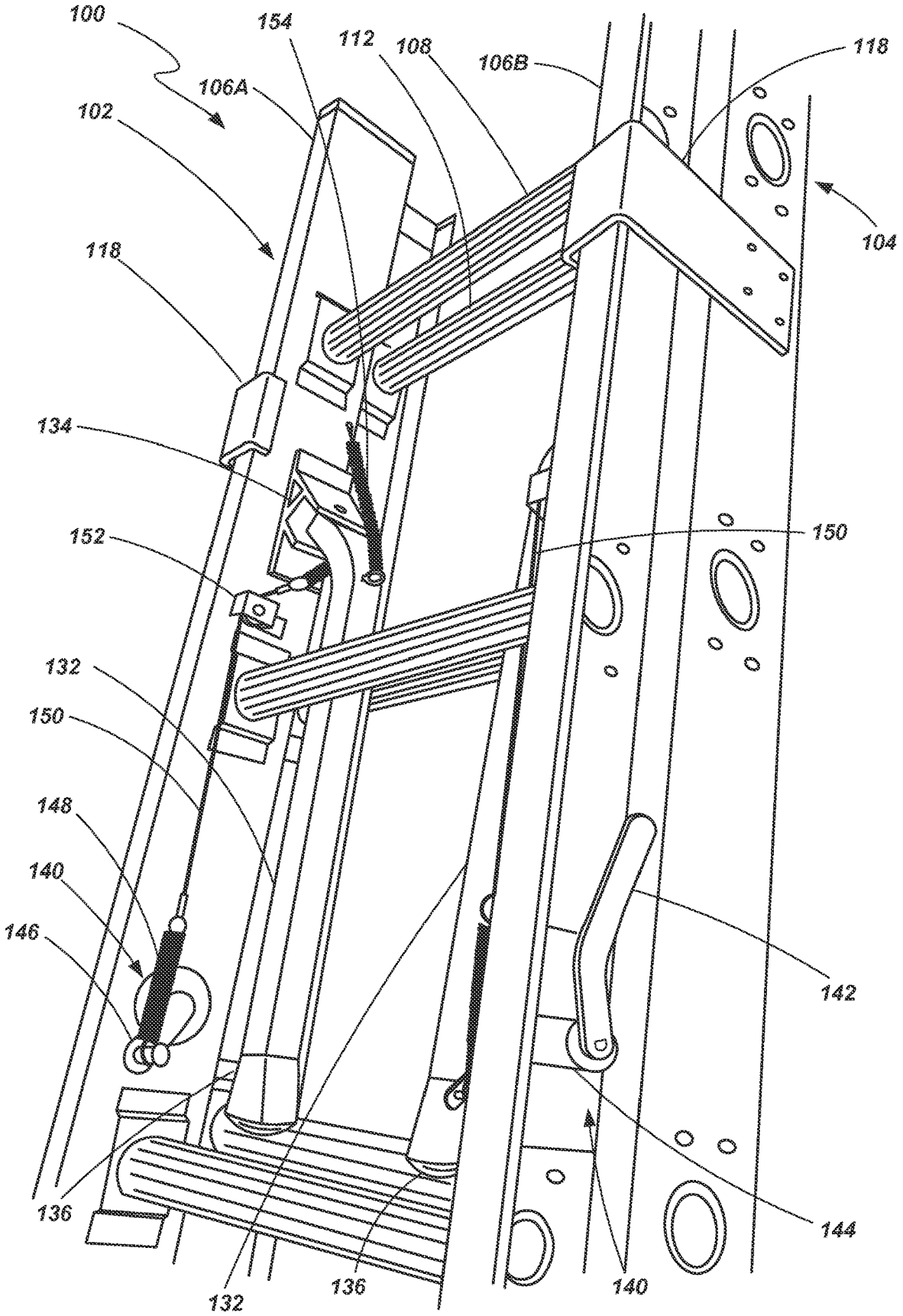
FIG. 4 is another perspective view of a portion of ladder and apparatus shown in FIG. 1.

Referring to FIG. 1, a ladder 100 is shown according to an embodiment of the invention. The ladder 100 is configured as an extension ladder and includes a first assembly, which may be referred to as a fly section 102, and a second assembly, which may be referred to as a base section 104, that is slidably coupled with the fly section 102. The fly section 102 includes a pair of spaced apart rails 106A and 106B with a plurality of rungs 108 extending between, and coupled to, the rails 106A and 106B. Similarly, the base section 104 includes a pair of spaced apart rails 110A and 110B with a plurality of rungs 112 extending between, and coupled to, the rails 110A and 110B. One or more mechanisms, often referred to as a rung lock 114, may be associated with the first and second assemblies 102 and 104 to enable selective positioning of the fly section 102 relative to the base section 104. This enables the ladder 100 to assume a variety of lengths (or, rather, heights when the ladder is in an intended operating orientation) by sliding the fly section 102 relative to the base section 104 and locking the two assemblies in a desired position relative to one another. By selectively adjusting the two rail assemblies 102 and 104 relative to each other, a ladder can be extended in length to nearly double its collapsed or shortest state, as will be appreciated by those of ordinary skill in the art. By way of example, a rung lock apparatus is described in U.S. Pat. No. 5,429,207 to Frank et al., issued Jul. 4, 1995, the disclosure of which is incorporated by reference herein in its entirety.

A foot 116 may be coupled to the lower end of each rail 110A and 110B of the base section 104 to support the ladder 100 on the ground or other surface. While not specifically shown, certain embodiments may include adjustable support members associated with the base section 104 to provide increased lateral stability as well as the ability to adjust the ladder for support on uneven surfaces. An example of such adjusting members is described in U.S. Pat. No. 8,365,865, issued on Feb. 5, 2013, the disclosure of which is incorporated by reference herein in its entirety. Another example of an arrangement incorporating an adjustable support member includes U.S. Patent Application Publication No. 20140202793 (U.S. patent application Ser. No. 14/162,992, filed on Jan. 24, 2014), the disclosure of which is incorporated by reference herein in its entirety.

The ladder 100 may additionally include a number of other components such as brackets (e.g., J-brackets 118), bearing members and/or end caps 119 to assist in maintaining the fly section 102 and base section 104 in their slidably coupled arrangement as will be appreciated by those of ordinary skill in the art.

Figure 6:
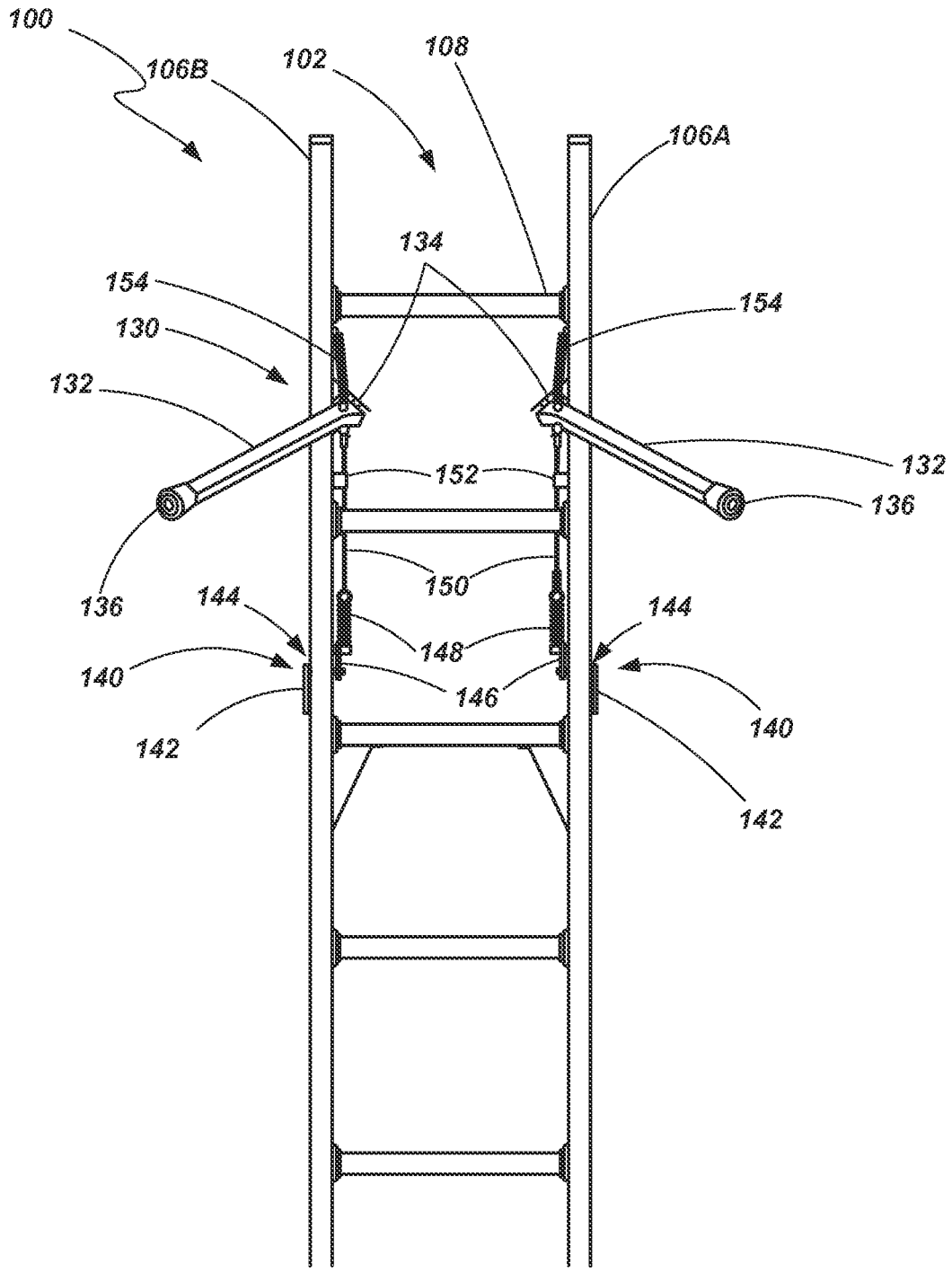
FIG. 6 is a rear view of a portion of the ladder and apparatus shown in FIG. 1 with the apparatus in the second position or state.
Figure 7:
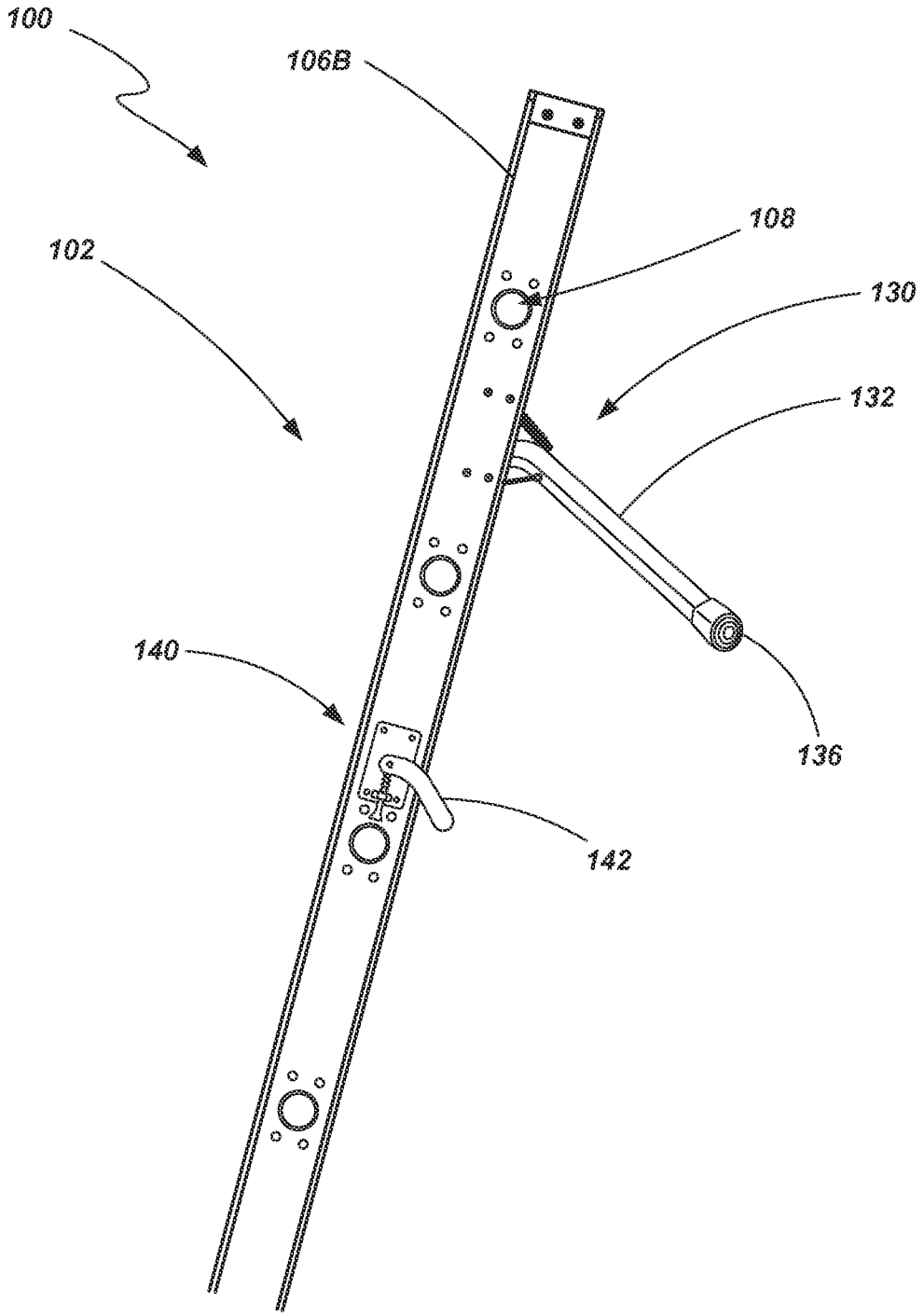
FIG. 7 is a side view of a portion of the ladder and apparatus shown in FIG. 1 with the apparatus in the second position or state.
Figure 8:
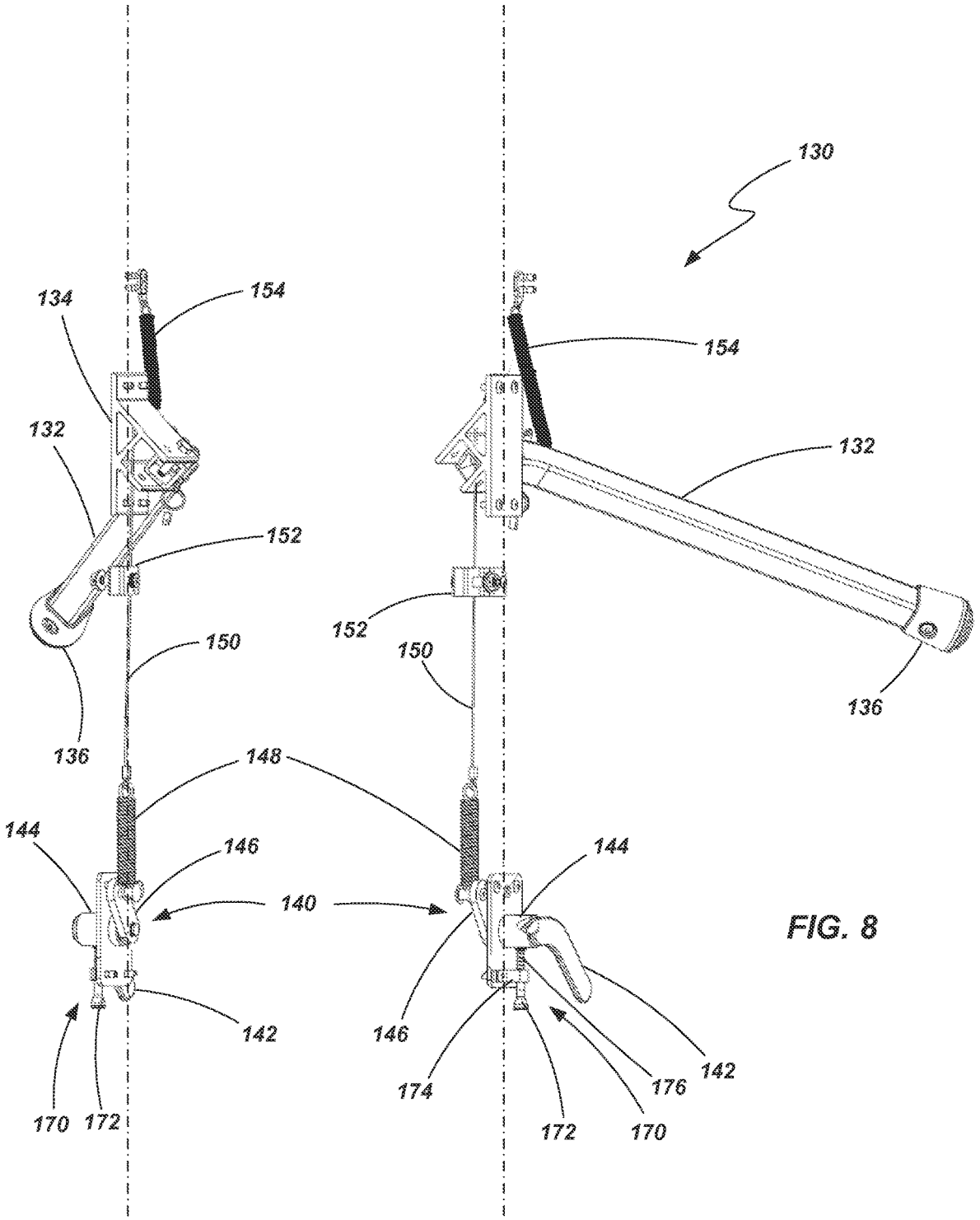
FIG. 8 is perspective view of the apparatus shown in FIG. 1, with the ladder removed and the apparatus in the second position or state.

As shown in FIGS. 1-8, a support apparatus, configured as a stand-off apparatus 130, is coupled to fly section 102 and is configured to support the ladder 100 by engaging a solid and stable structure. For example, rather than placing the rails 106A and 106B of the fly section 102 against a gutter (e.g., a rain gutter) or other structure which may not be strong enough to support the weight of the ladder 100 and a user standing thereon, the stand-off apparatus 130 may be used to engage an adjacent wall, roof or other stable structure to provide stability to the ladder while in use. It is noted that FIG. 8 shows the stand-off apparatus 130 in a deployed state but without the ladder 100 for sake of clarity. The two axes shown in FIG. 8 extend generally along, or at least parallel to, the longitudinal axes of the rails 106A and 106B of the fly section 102.

In the embodiment shown in FIGS. 1-8, the stand-off apparatus 130 includes a pair of arms 132 that are pivotally coupled to the rails 106A and 106B of the fly section 102 by way of associated brackets 134. End members or end caps 136 are coupled to, or formed at, the ends of the arms 132. The end caps 136 may be configured to provide cushion and/or an anti-slip, frictional surface for engagement of, for example, a wall or roof structure. When the arms 132 are in a stored state (such as shown in FIGS. 1-4), they are positioned such that they extend generally downward from the brackets 134 (towards the feet 116 of the ladder 100) and may be positioned between the rungs 108 of the fly section 102 and the rungs 112 of the base section 104.

Figure 5:
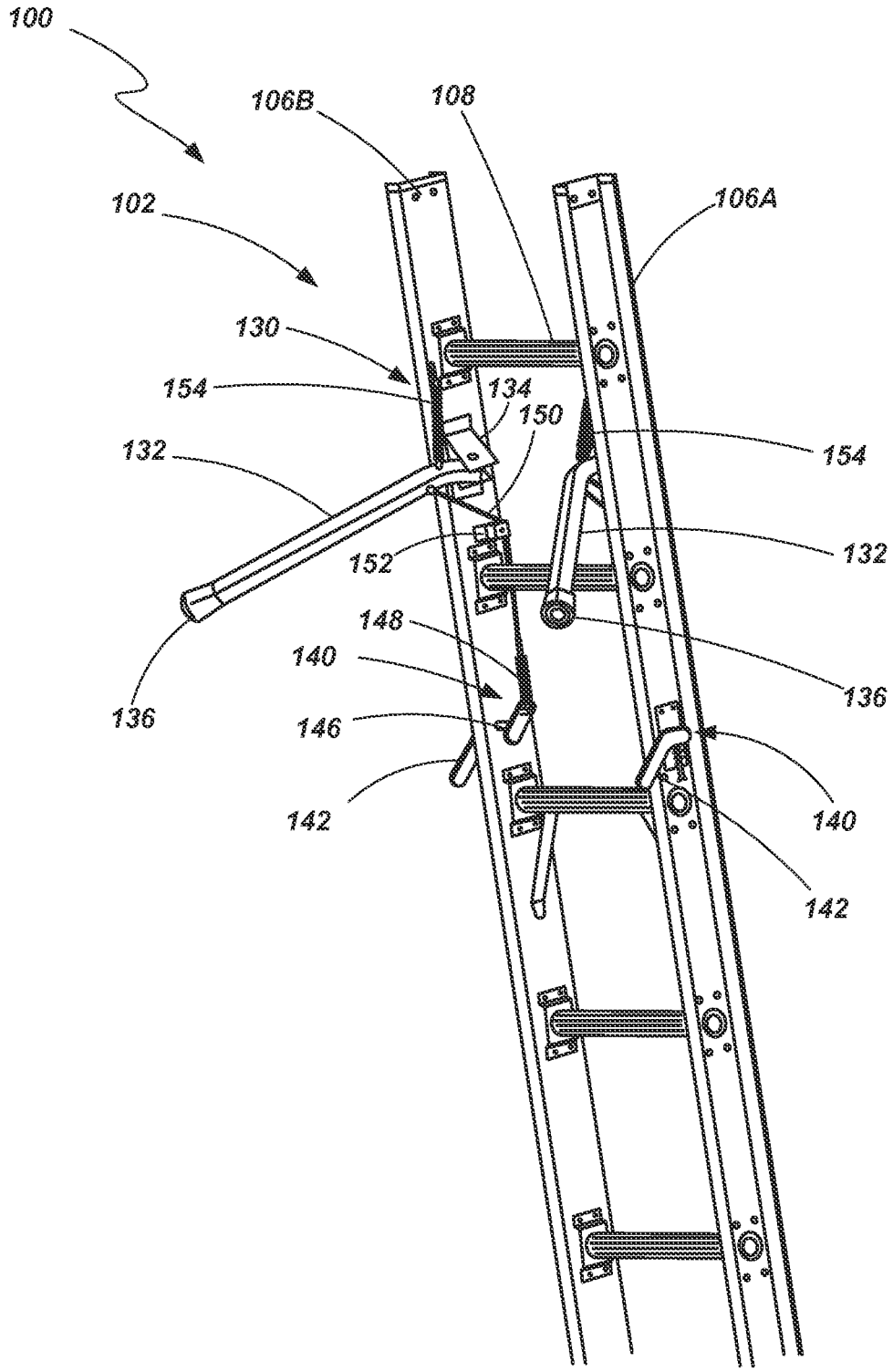
FIG. 5 is a rear perspective view of a portion of the ladder and apparatus shown in FIG. 1 with the apparatus in a second position or state.

When in a deployed or usable state the arms 132 are positioned such that they extend laterally outward from the ladder rails 106A and 106B of the fly section 102 (such as shown in FIGS. 5-7). When in the deployed state, the arms may extend such that the end caps 136 are positioned to be wider than the rails 106A and 106B of the fly section 102 as best seen in FIG. 6 which is a view looking directly at the back side of the ladder 100. Of course, other embodiments are also contemplated with the end caps 136 being wider than the width of the rails 106A and 106B (e.g., 1.5 times the width of the rails, 2 times the width of the rails, 2.5 times the width of the rails, or greater than 3.5 times the width of the rails). This results in an increased width of the support surfaces of the ladder 100. For example, in one embodiment, the width or distance between the end caps 136 when in a deployed state may be between 3 and 3.5 times the width or distance between the rails 106A and 106B of the fly section 102. The increased width of the support surface provides greater stability to the ladder, particularly in the event that a user suddenly shifts his or her weight on the ladder or otherwise distributes their weight asymmetrically on the ladder.

Additionally, as shown in FIGS. 5 and 7, the arms 134 may be configured to exhibit a generally downward extension, relative to a horizontal axis when the ladder is in a position of intended use. Stated another way, when view from the side (i.e., as in FIG. 7), an included angle extending upward along a rail (e.g., 106A or 106B) to the coupling of the rail with the arm 132, and then through the arm 132, may be an acute angle. However, in other embodiments, such an angle may be configured otherwise and include a normal angle or an obtuse angle.

In the embodiment shown in FIGS. 1-8, the arms 132 may include a first, curved section adjacent the end that is pivotally coupled with a bracket 134 and a second, substantially straight section extending from the first section. Such a configuration may assist in positioning the arms at a desired location relative to the rails 106A and 106B (e.g., the width, the angle relative to horizontal, etc.) while still enabling the arms 132 to retract to a desired position for storing and transportation of the ladder 100.

An actuation mechanism 140 is associated with each arm and enables the arms 132 to transition between the stored state and the deployed state automatically upon extending and refracting the fly section 102 relative to the base section 104. In the embodiment shown, there is a separate actuation mechanism 140 for each arm 132 and the arms 132 function independently of each other. However, in other embodiments, the arms could be coupled to one another and a single actuation mechanism may be employed to deploy/retract both arms.

Each actuation mechanism 140 includes an engagement arm 142 positioned adjacent the laterally outer side of a rail (106A or 106B) of the fly section 102. When the fly section 102 is refracted relative to the base section 104 such that the ladder 100 is in a compact or refracted state, the engagement arm 142 engages a surface of a rail (110A or 110B) of the base section 104 such that it is displaced about a pivot member 144 coupled with the associated rail (106A or 106B) of the fly section 102 as shown in FIGS. 1-4. The engagement arm 142 is also coupled with a pull arm 146 by way of the pivot member 144 such that, when the engagement arm 142 rotates about the pivot member 144, the pull arm 146 likewise rotates. The pull arm 146 is located on the opposite side of the rail (106A or 106B) of the fly section 102 relative to the engagement arm 142. In other words, the pull arm is located along the laterally inward side of its associated rail (106A or 106B).

A biasing member, such as a coil spring 148 may have one end coupled to the pull arm 146 and another end coupled with a cable 150. The cable 150 may extend through one or more pulleys 152 or other redirecting members and be coupled to an associated arm 132. Another biasing member, such as another coil spring 154, may have a first end coupled to an associated arm 134 and a second send coupled with an associated rail (106A or 106B) of the fly section. While not specifically shown, another biasing member or spring may be associated with the engagement arm 142 and/or pull arm 146 to bias these components toward a preferred rotational position.

As noted above, the arms 132 of the stand-off device are in a refracted or stored state when the fly section 102 is retracted or lowered relative to the base section such as shown in FIGS. 1-4. When a user extends the fly section 102 upward relative to the base section 104 in order to make the ladder longer (or "taller"), the rails 106A and 106B of the fly section 102 are displaced relative to the rails 110A and 110B of the base section 104 until the engagement arm 142 of the actuating mechanism 140 becomes disengaged from, or out of contact with, its associated rail 110A or 110B of the base section 104. This enables the engagement arms 142 and associated pull arms 146 to rotate to a position such as shown in FIGS. 5-7. At the same time, displacement of the fly section 102 relative to the base section 104 places the arms 132 in a position, relative to the base section 104, such that they now clear any rungs 112 of the base section 104. Rotation of the engagement arms 142 and pull arms 146 relieves tension within the cables 150 such that the second springs 154, which are in tension while the stand-off device 140 is in the retracted/stored state, pull the arms 132 toward their deployed state (see FIGS. 5-7).

When the stand-off device 130 is in a deployed condition, and the fly section 102 is refracted or lowered relative to the base section 104, the engagement arms 142 eventually come in contact with an associated rail 110A and 110B of the base section. Further refraction of the fly section 102 relative to the base section 104 causes the engagement arm 142 to rotate about the pivot member 144, also resulting in the rotation of the associated pull arm 146. Rotation of the pull arm 146 causes displacement of the cable 150 which pulls the arms 132 from their deployed state (FIGS. 5-7) to their refracted state (FIGS. 1-4) and increases the tension of the second springs 154.

It is noted that the embodiment described above is directed to arms 132 mounted to the inner side surfaces of the rails 106A and 106B and which are positioned between the rails 106A and 106B of the fly section 102 when in the stored or refracted position. While such a configuration may be preferred in certain situations and offers certain advantages, in other embodiments, the arms 132 may be coupled to another surface (other than the inner side surface) of an associated rail 106A and 106B of the fly section 102. More specifically, the arms 132 may be coupled to the outer sides of the rails 106A and 106B (opposite that which is shown in the drawings) and configured to collapse and lie along the outer side surfaces of the rails 106A and 106B when in a refracted or stored state. In other embodiments, the arms 132 may be coupled to a front or rear surface of the rails 106A and 106B.

Figure 9:
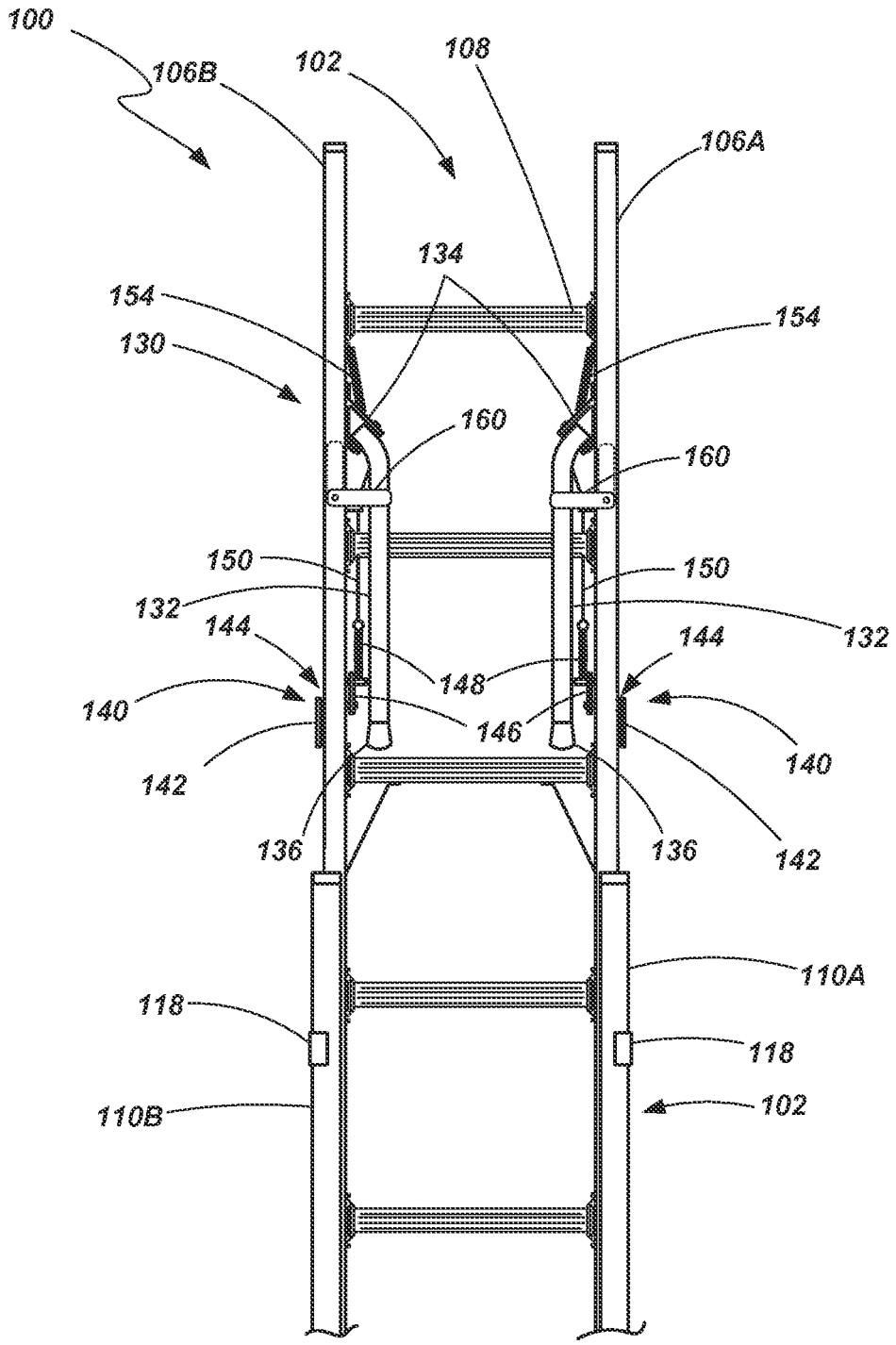
FIG. 9 is a rear view of a portion of the ladder and apparatus shown in FIG. 1 with the apparatus locked in the first position or state.

Referring briefly to FIG. 9, a rear view of a portion of the ladder 100 is shown. In FIG. 9, the fly section 102 is shown being extended from the base section 104. However, even though the fly section 104 has been extended a sufficient distance to enable rotation of the engagement arm 142 of the actuating mechanism. This is due to the use of a locking mechanism to prevent deployment of the arms 132 regardless of the position of the fly section 102 relative to the base section. For example, in the embodiment shown in FIG. 9, a locking mechanism may include a locking arm 160 pivotally coupled with the rails 106A and 106B (or some other component) of the fly section 102. Thus, the locking arms 160 may be rotated from a first position (shown in dashed lines in FIG. 9) wherein the arms 132 are permitted to be deployed, to a locked position (shown in solid lines in FIG. 9) where they prohibit the arms 132 from rotating to the deployed position. The locking mechanism may be selectively deployed by a user so that when a user desires to use the ladder 100 without the aid of the stand-off mechanism 130 (or other support mechanism), they may do so. While not specifically shown, the locking mechanism may be configured so that it may be actuated by a user at a location near the lower portion of the ladder 100 (e.g., using rods, levers, cables or the like). Thus, a user may stand the ladder 100 in a generally upright position, actuate the locking mechanism, and then extend the fly section 102 from the base section 104 rather than having to access the upper portion of the ladder 100 (e.g., the location of the locking arms 160) prior to raising the ladder 100 toward a generally upright position.

Referring again to FIG. 8, another locking mechanism 170 is shown according to another embodiment. The locking mechanism 170 may include a lock pin 172 coupled with a bracket 174 and may include a biasing element 176 configured to bias the lock pin 172 towards an unlocked position. The lock pin 172 may be configured to interact with the pivot member 144 of the actuating mechanism to inhibit the shaft from rotating (hence keeping the arms 132 from being displaced outward to a deployed position). In one embodiment, the lock pin 172 may frictionally engage a surface of the pivot member 144 to inhibit rotation thereof. In another embodiment, the lock pin 172 may be configured to engage a feature of the pivot member 144 (e.g., an abutment, a hole, a keyway, a geared surface) to hold the pivot member in a desired rotation position, preventing it from rotating and the arms 132 from deploying. In one embodiment, the lock pin 172 may include a threaded portion that engages with a cooperating threaded section of the bracket 174 to displace the lock pin 172 towards or away from the pivoting member 144. In another embodiment, the locking pin 172 may interact with the bracket 174 by way of a keyed channel that enable the pin to be displaced towards the pivot member 144 and then be locked in place, such as by twisting it relative to the bracket 174. Of course other locking mechanisms may also be employed to prevent or inhibit the pivot member (and associated components) from rotating when the fly section 102 is displaced upwards relative to the base section 102.

Figure 10:
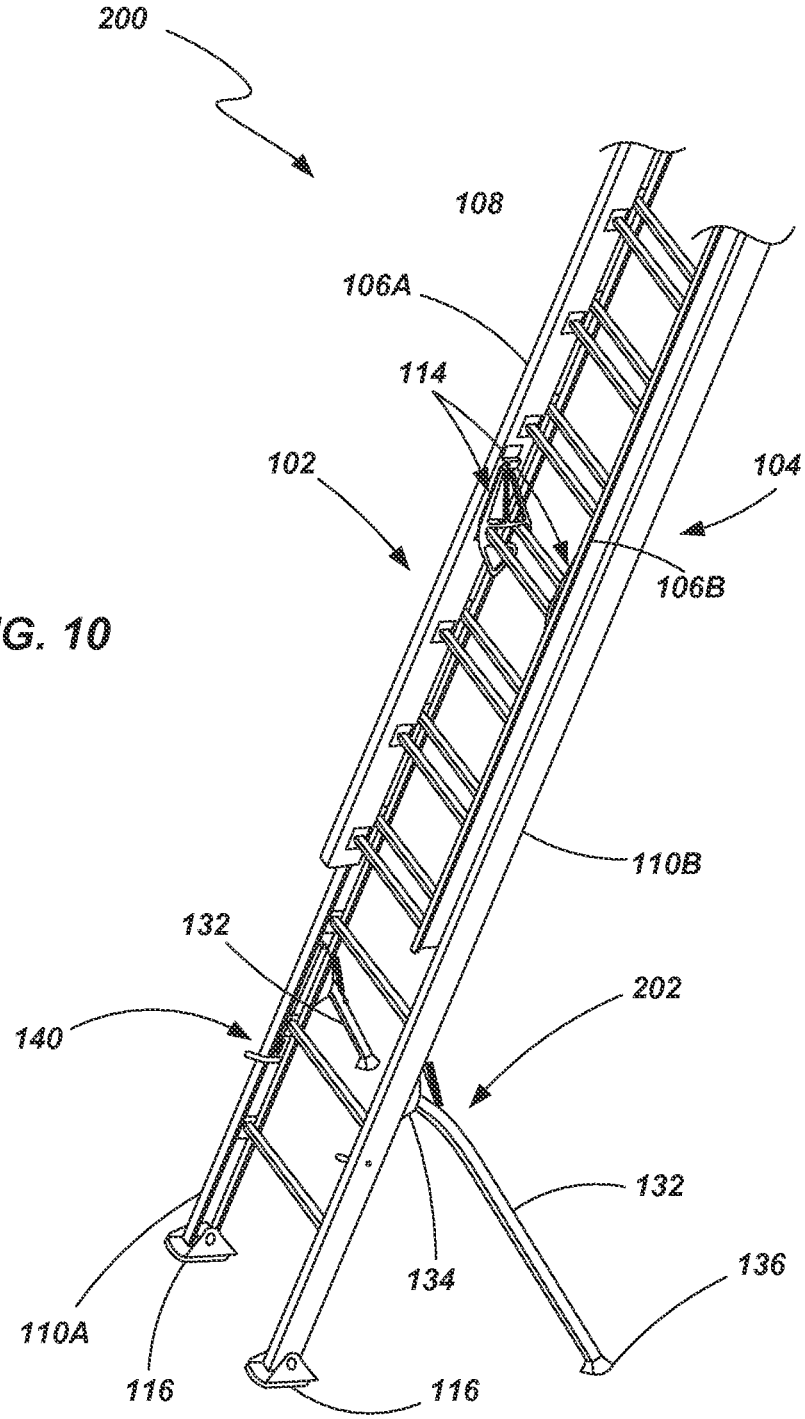
FIG. 10 is a perspective view of a ladder having a support apparatus according to an embodiment of the present invention.

Referring to FIG. 10, the lower portion of a ladder 200 is shown according to another embodiment of the invention. The ladder 200 is configured similarly to the ladder 100 described hereinabove, including, generally, a first assembly (e.g., a fly section 102) and a second assembly (e.g. a base section 104) that is slidably coupled with the fly section 102. The fly section 102 includes a pair of spaced apart rails 106A and 106B with a plurality of rungs 108 extending between, and coupled to, the rails 106A and 106B. Similarly, the base section 104 includes a pair of spaced apart rails 110A and 110B with a plurality of rungs 112 extending between, and coupled to, the rails 110A and 110B. A rung lock 114 may be associated with the first and second assemblies 102 and 104 to enable selective positioning of the fly section 102 relative to the base section 104. A foot 116 may be coupled to the lower end of each rail 110A and 110B of the base section 104 to support the ladder 100 on the ground or other surface.

Additionally, the ladder 200 includes a support apparatus, configured as a stabilizer apparatus 202. The stabilizer apparatus 202 may include many components that are the same as, or generally similar to, the stand-off apparatus described above. For example, the stabilizer apparatus may include one or more arms 132 pivotally coupled to the rails 110A and 110B of the base section 104 by way of associated brackets 134. End caps 136 may be coupled with the ends of the arms 132 and configured for engaging the ground or some other support surface. An actuating mechanism 140, including, for example, rotating levers, cables, pulleys, springs and associated components to effect automated deployment and refraction of the arms, relative to the base section 104, in a manner similar to that which has been described above with respect to the stand-off apparatus 130. The apparatus 202 may also include a locking mechanism (e.g., similar to either mechanism 160 or 170 described above) to selectively prevent the arms 132 from deploying if desired.

While not shown, when the arms 132 of the stabilizer apparatus are in a refracted position, they may be positioned along the back side of the base section 104, extending adjacent to the rails 110A and 110B thereof. When deployed, as shown, the arms 134 may be pivoted to a position to engage the ground or other support surface, providing added stability and security to the ladder 200. When deployed, the arms 136 may extend outward such that the feet 136 are positioned wider than the spacing of the rails 110A and 110B to provide an expanded base for the ladder 200.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A ladder comprising:

a first assembly comprising a first pair of spaced apart rails and a first plurality of rungs extending between and coupled to the first pair of spaced apart rails;

a second assembly comprising a second pair of spaced apart rails a second plurality of rungs extending between and coupled to the second pair of spaced apart rails, and a pair of feet, each foot of the pair of feet being coupled with an associated rail of the second pair of spaced apart rails, the second assembly being slidably coupled to the first assembly;

a stand-off apparatus coupled with the first assembly, the stand-off apparatus comprising a first arm having a first end pivotally coupled with an upper portion of a first rail of the first pair of spaced apart rails and a second arm having a first end pivotally coupled with an upper portion of a second rail of the first pair of spaced apart rails, wherein each of the first arm and the second arm is pivotally displaced from a retracted position to a deployed position responsive to displacement of the first assembly a specified distance in a first direction relative to the second assembly;

wherein, when in the retracted position, each of the first arm and the second arm is positioned between a first rung of the first plurality of rungs and a second rung of the second plurality of rungs, and wherein, when in the deployed position, a second end of the first arm extends rearwardly from the ladder;

a first actuating mechanism associated with the first arm, the first actuating mechanism including:

a first engagement arm pivotally coupled to the first rail of the first pair of rails on a first side thereof;

a first pull arm coupled with the engagement arm and located on a second side of the first rail of the first pair of rails and between the rails of the first pair of rails; and a first cable coupled between the first pull arm and the first arm;

wherein, the first engagement arm assumes a first rotational position and engages a surface of a first rail of the second pair of rails when the first arm is in a retracted position and wherein the first engagement arm assumes a second rotational position and is disengaged from contact with the first rail of the second pair of rails when the first arm is in the deployed position.

2. The ladder of claim 1, wherein the second end of the first arm is positioned adjacent the first rail of the first pair of rails when the first arm is in the retracted position and wherein the second end of the second arm is positioned adjacent the second rail of the first pair of rails when the second arm is in the retracted position, wherein the first arm and the second arm are displaced from their deployed positions to their retracted positions responsive to displacement of the first assembly a specified distance in a second direction, opposite the first direction, relative to the second assembly.

3. The ladder of claim 1, wherein the first pair of spaced apart rails exhibits a first width between the first rail and the second rail, and the second end of the first arm and the second end of the second arm exhibit a second width when the first arm and the second arm are in their deployed positions, the second width being at 1.5 times the first width.

4. The ladder of claim 1, further comprising a locking mechanism configured to selectively prohibit movement of the first arm from the retracted position to the deployed position.

5. The ladder of claim 4, wherein the locking mechanism includes a locking arm positioned adjacent the first arm, the locking arm being selectively displaceable between a first position and a second position.

6. The ladder of claim 1, further comprising a second actuating mechanism associated with the second arm, the second actuating mechanism including:

a second engagement arm pivotally coupled to a second rail of the first pair of rails on a first side thereof;

a second pull arm coupled with the engagement arm and located on a second side of the second rail of the first pair of rails and between the rails of the first pair of rails; and a second cable coupled between the second pull arm and the second arm.

7. The ladder of claim 1, further comprising a first spring having a first end coupled with the first rail of the first pair of rails and a second end coupled with the first arm.

8. The ladder of claim 7, further comprising a second spring coupled between the first cable and the first pull arm.

9. The ladder of claim 8, wherein the first arm includes a first, arcuate section and a second, substantially straight section.

10. A ladder comprising:

a base section comprising a first pair of spaced apart rails and a first plurality of rungs extending between and coupled to the first pair of spaced apart rails;

a fly section comprising a second pair of spaced apart rails and a second plurality of rungs extending between and coupled to the second pair of spaced apart rails, the fly section being slidably coupled to the base section;

a stand-off apparatus coupled with the fly section, the stand-off apparatus comprising a first arm coupled with a first rail of the second pair of rails and pivotally displaced between a first position, wherein the first arm is positioned between a first rung of the first plurality of rungs and a second rung of the second plurality of rungs, and a second position wherein a substantial portion of the first arm extends out of a volume defined by the second pair of rails;

wherein the stand-off apparatus is configured to automatically deploy the first arm from the first position to the second position upon displacing the fly section a predetermined distance relative to the base section in a first direction, and wherein the stand-off apparatus is configured to retract the first arm from the second position to the first position upon displacing the fly section relative to the base section in a section direction opposite the first direction until the fly section is at a predetermined position relative to the base section; and a locking mechanism configured to selectively prohibit pivotal movement of the first arm from the first position to the second position regardless of a position of the fly section relative to the base section.

11. The ladder of claim 10, wherein the stand-off apparatus further includes a second arm coupled with a second rail of the second pair of rails and pivotally displaced between a first position, wherein the second arm is positioned between the first rung of the first plurality of rungs and the second rung of the second plurality of rungs, and a second position wherein a substantial portion of the second arm extends out of the volume defined by the second pair of rails.

12. The ladder of claim 11, wherein the first arm pivots between its first position and its second position independent of the pivotal displacement of the second arm.

13. The ladder of claim 10, further comprising an actuating mechanism associated with the first arm, the actuating mechanism including:

an engagement arm pivotally coupled to the first rail of the second pair of rails on a first side thereof;

a pull arm coupled with the engagement arm and located on a second side of the first rail of the second pair of rails; and a cable coupled between the pull arm and the first arm.

14. The ladder of claim 13, further comprising a first spring having a first end coupled with the first rail of the second pair of rails and a second end coupled with the first arm.

15. The ladder of claim 14, further comprising a second spring coupled between the cable and the pull arm.

16. The ladder of claim 15, wherein the first arm includes a first, arcuate section and a second, substantially straight section.

17. The ladder of claim 16, further comprising an end cap coupled with an end of the second section of the first arm.

18. The ladder of claim 17, further comprising a pulley, wherein the cable passes through the pulley.

19. The ladder of claim 10, wherein the locking mechanism includes a locking arm associated with the fly section, the locking arm being selectively displaceable between a first position and a second position.

* * * * *